US006089994A

United States Patent [19]

Sun

[11] Patent Number: 6,089,994

[45] Date of Patent: Jul. 18, 2000

[54] GOLF CLUB HEAD WITH SELECTIVE WEIGHTING DEVICE

[76] Inventor: Donald J. C. Sun, No. 4 Young-Kung 6th Rd., Yong -Ann Ind. Dist., Young Ann Hsiang, Taiwan

[21] Appl. No.: 09/152,023

[22] Filed: Sep. 11, 1998

[51] Int. Cl.[7] ..... A63B 53/04

[52] U.S. Cl. ..... 473/338; 473/341

[58] Field of Search ..... 473/334, 335, 473/338, 341

[56] References Cited

U.S. PATENT DOCUMENTS

| | | | |
|---|---|---|---|
| 4,043,563 | 8/1977 | Churchward | 473/338 |
| 4,695,054 | 9/1987 | Tunstall | 473/338 |
| 5,013,041 | 5/1991 | Sun et al. . | |
| 5,050,879 | 9/1991 | Sun et al. . | |
| 5,154,424 | 10/1992 | Lo | 473/338 |
| 5,273,283 | 12/1993 | Bowland | 473/338 |

*Primary Examiner*—Kien T. Nguyen

[57] ABSTRACT

A weighting insert has a plurality of weights installed therein which are arranged in a circular configuration. Certain ones of these weights are made of a different material than the others, such material having a different density, thus making for a substantially different weight. A golf club head has a receptacle in its sole. This receptacle has a plurality of apertures arranged in a circular configuration formed therein. The insert has a key formed therein which is adapted to fit into any one of said apertures. The weighting device can be rotated to position the key in a selected one of the apertures and the insert removably attached to the sole in this selected position. In this manner the weighting of the sole of the golf club head can be varied, as desired. The weights can either be permanentaly installed in the insert or can be removable for selective positioning.

5 Claims, 2 Drawing Sheets

GOLF CLUB HEAD WITH SELECTIVE WEIGHTING DEVICE

BACKGROUND OF THE INVENTION

1. Field of the Invention

This invention relates to a weighting device for a golf club head and more particularly to such a weighting device which can be selectively positioned on the sole of the head to provide various different weighting.

2. Description of the Related Art

It is well known that the location of the center of gravity of a golf club head has a significant effect on the driving characteristics thereof, particularly for less skilled and experienced golfers. The change of the location of this center of gravity can be adjusted to compensate for hook or slice. Prior art devices for selectively varying the weighting of golf club heads are described in my U.S. Pat. No. 5,050,879 issued Sep. 24, 1991 and my U.S. Pat. No. 5,013,041 issued May 7, 1991. With these prior art devices, the center of gravity can be changed to different points between the toe and heel of the golf club head.

SUMMARY OF THE INVENTION

The device of the present invention is an improvement over the prior art in that it provides a simpler, more easily weight adjusting device for a golf club head. This end result is achieved by employing a circular insert for adjusting the center of gravity which insert is removably fitted into a mating circular receptacle in the sole of the golf club head. This insert has a plurality of weights installed therein running therearound in a circular configuration. Selective ones of these weights have a different density and weight than the other weights. The receptacle has a plurality of apertures formed therein arranged in a circular configuration. The insert has a key thereon which is adapted to fit into any one of the receptacle apertures. The insert is rotatably positioned in the insert to selectively provide any one of a number of centers of gravity for the head and then removably attached to the head in this selected position. The center of gravity can be changed merely by removing the insert and rotatably setting it in a different position. The weights can be permanently installed in the insert or can be removably installed so that their positioning and numbers of weights of different density can be changed.

It is therefore an object of this invention to provide an improved golf device for selectively setting the center of gravity of a golf club head.

It is a further object of this invention to enable the adjustment of the center of gravity of a golf club head to suit the particular swing habits of the user.

Other objects of the invention will become apparent in view of the following description taken in connection with the accompanying drawings.

DETAILED DESCRIPTION OF THE INVENTION

Figure 1:
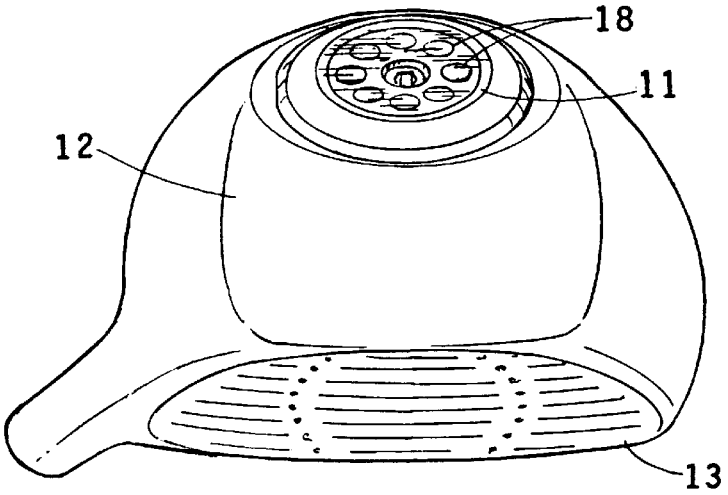
FIG. 1 is a bottom side perspective view showing a preferred embodiment of the invention.
Figure 2:
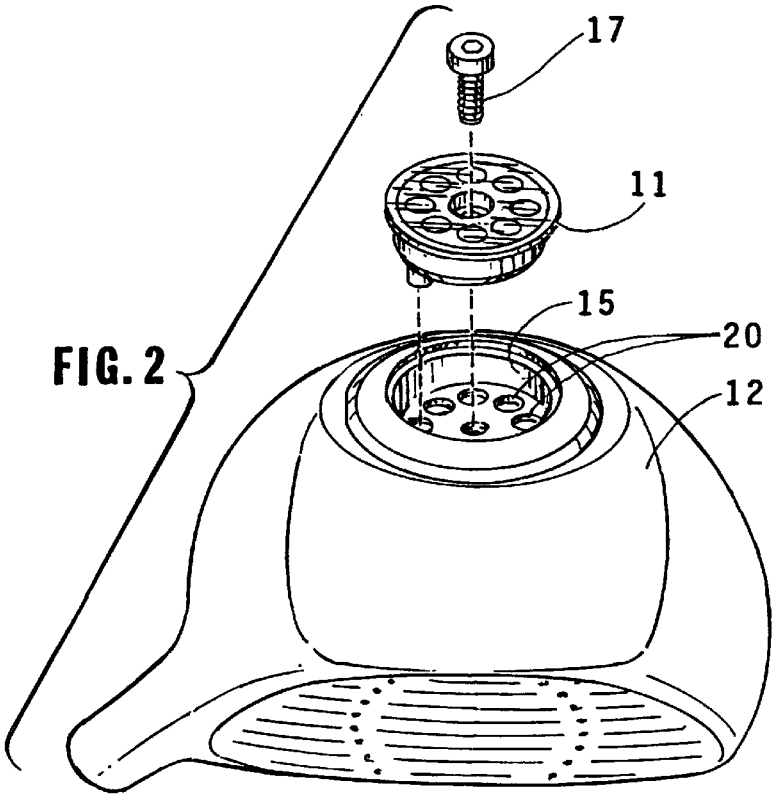
FIG. 2 is a an exploded bottom side perspective view showing the preferred embodiment with the insert in the process of being installed in the golf club head.

Referring now to FIGS. 1–4, a first embodiment of the invention is illustrated. As shown in FIG. 1, a weighting insert 11 is removably attached to the sole 12 of golf club head 13. The insert is installed in receptacle 15 formed in sole 12 and retained in position by means of screw 17 which threadably engages the sole.

Insert 11 has a plurality of weights 18 of the same size permanently installed therein in a circular configuration. Certain of these weights are made of a material of one density while others are made of a material having a difference density thus making for different weighting. Typically the weights may be of a plastic material(1.0 g/cm3), titanium(4.6 g/cm3), aluminum(2.70 g/cm3), brass(8.5 g/cm3, copper(8.9 gcm3), or tungsten(17.0 g/cm3). The various weights can be arranged as desired to provide the desired weighting of the head. A series of weighting inserts having different weighting characteristics can be provided to the user so that the weighting can be changed, as desired.

Figure 3:
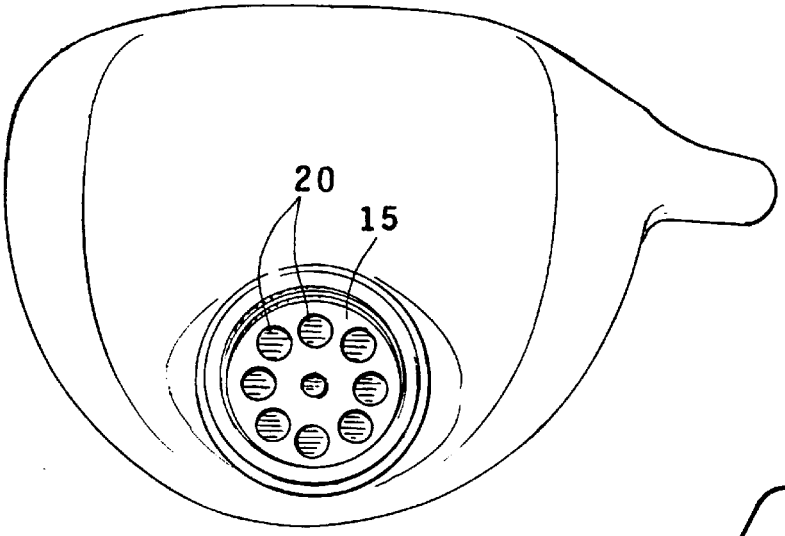
FIG. 3 is a bottom plan view of the preferred embodiment with the insert removed from the receptacle of the sole of the golf club head.
Figure 4:
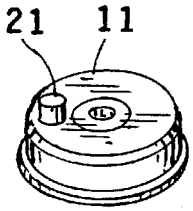
FIG. 4 is a bottom perspective view of the insert of the preferred embodiment.

As can best be seen in FIG. 3, receptacle 15 has a plurality of apertures 20 formed therein in a circular configuration so as to correspond with circular configuration of the weights 18. As shown in FIG. 4, a key 21 is formed in the bottom of insert 11, this key fitting into any one of the apertures 20. The insert 11 thus can be rotatably positioned in receptacle 15 as may be desired to achieve a particular weighting characteristic. When in the desired position, key 21 will fit into one of the apertures 20 and prevent rotation of the weighting insert. Screw 17 is then tightened to retain the insert in position.

Figure 5:
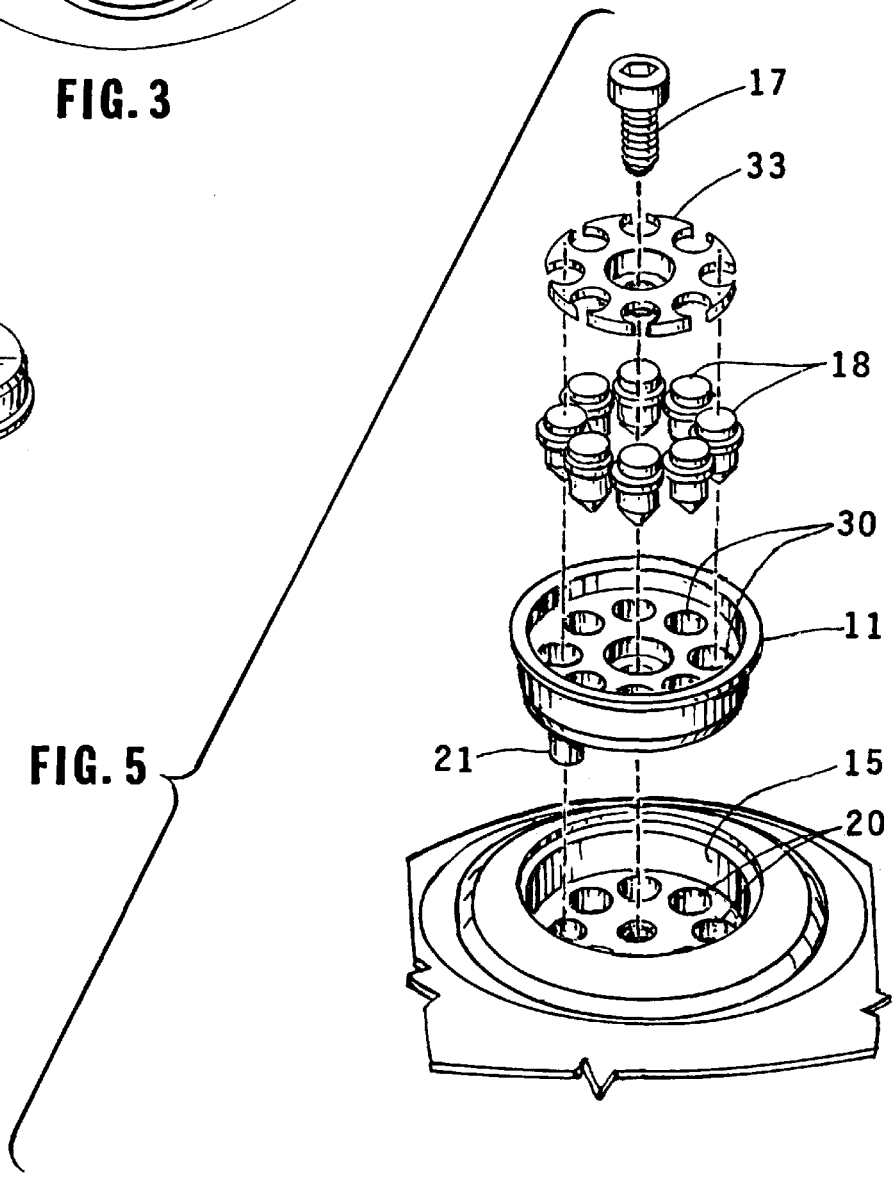
FIG. 5 is a top perspective exploded view illustrating a second embodiment of the invention having removable weights.

Referring now to FIG. 5, a second embodiment of the invention is illustrated. In the second embodiment the weights, 18 rather than being permanently installed in the weighting insert 11, are removably installed in apertures 30 formed therein. Thus, various weights can be installed in any desired configuration and changed for different weighting requirements, as the situation may demand. Otherwise the weighting insert is rotatably positioned in the receptacle 15, keyed in this position with key 21 fitted into one of apertures 20 and retained in position by means of screw 17, as in the first embodiment. Retainer unit 33 is used to retain the weights in place.

With the device of the invention, a great variety of different combinations of weights can be employed to provide a great variety of different centers of gravity for a golf club head.

While the invention has been described and illustrate in detail it is to be understand that this is intended by way of illustration and example only, the scope of the invention being limited by the terms of the following claims.

I claim:

1. In a golf club head having a sole portion with a circular receptacle formed therein, a weighting device for use in selectively adjusting the weighting of said head to change the center of gravity thereof comprising:

a circular weighting insert member having a plurality of weights installed therein and running therearound in a circular configuration, selective ones of said weights having a different density and weight that the others of said weights, means for selectively installing said insert member in said receptacle in any one of a plurality of circular positions, each of said positions giving said head a different center of gravity, said installing means comprising a plurality of apertures formed in said receptacle in a circular configuration and a key formed in said insert member adapted to fit into any one of said receptacle apertures, and means for removably retaining said insert member in said receptacle.

2. The device of claim 1 wherein said weights are removably installed in said weighting insert member.

3. The device of claim 1 wherein said weights are permanently installed in said weighting insert member.

4. The device of claim 1 wherein said means for removably retaining said weight member in said receptacle comprises a screw which fits through said weight member and threadably engages said receptacle.

5. The device of claim 1 wherein said weights are of a material selected from the group consisting of plastic, titanium, aluminum, brass, copper, and tungsten.

* * * * *